US010381211B2

(12) United States Patent
Ng et al.

(10) Patent No.: US 10,381,211 B2
(45) Date of Patent: Aug. 13, 2019

(54) METHOD AND SYSTEM OF ATMOSPHERIC PRESSURE MEGAVOLT ELECTROSTATIC FIELD IONIZATION DESORPTION (APME-FID)

(71) Applicant: THE UNIVERSITY OF HONG KONG, Hong Kong (HK)

(72) Inventors: Kwan Ming Ng, Hong Kong (HK); Ho Wai Tang, Hong Kong (HK); Sin Heng Man, Hong Kong (HK)

(73) Assignee: THE UNIVERSITY OF HONG KONG, Hong Kong (HK)

( * ) Notice: Subject to any disclaimer, the term of this patent is extended or adjusted under 35 U.S.C. 154(b) by 0 days.

(21) Appl. No.: 15/283,522

(22) PCT Filed: Apr. 10, 2015

(86) PCT No.: PCT/CN2015/076322
§ 371 (c)(1),
(2) Date: Oct. 3, 2016

(87) PCT Pub. No.: WO2015/154719
PCT Pub. Date: Oct. 15, 2015

(65) Prior Publication Data

US 2017/0084442 A1 Mar. 23, 2017

Related U.S. Application Data

(60) Provisional application No. 61/978,447, filed on Apr. 11, 2014.

(51) Int. Cl.

| | |
|---|---|
| ***H01J 49/16*** | (2006.01) |
| ***H01J 49/04*** | (2006.01) |
| ***H01J 49/28*** | (2006.01) |

(52) U.S. Cl.
CPC ..... *H01J 49/168* (2013.01); *H01J 49/0459* (2013.01); *H01J 49/16* (2013.01); *H01J 49/282* (2013.01); *H01J 49/04* (2013.01)

(58) Field of Classification Search
None
See application file for complete search history.

(56) References Cited

U.S. PATENT DOCUMENTS 1,991,236 A * 2/1935 Van De Graaff ..... H02N 1/12 15/1.51
2,714,679 A * 8/1955 Van De Graaff ..... H01J 5/06 250/399

(Continued)

OTHER PUBLICATIONS

Jiangjiang et al. "Leaf spray: Direct Chemical analysis of plant material and living plants by mass spectrometry", analytical chemistry (2011).*

(Continued)

*Primary Examiner* — Michael J Logie
(74) *Attorney, Agent, or Firm* — Amin, Turocy & Watson LLP

(57) ABSTRACT

On field ionization under ambient conditions is described and applied on both ionization and desorption of various chemicals and biochemical present on the surface of materials in solid, liquid or gas states. The Atmospheric Pressure Megavolt Electrostatic Field Ionization Desorption (APME-FID) method generates ions directly from the surface of samples connected to a high electrical voltage at megavolt conditions. Megavolt electrostatic potential is generated and gradually accumulated directly on the sample surface by a Van de Graaff generator without causing damage to the sample. Therefore, when coupled with mass spectrometric system, the APME-FID-MS method enables direct detection of analytes on the surface of samples in different sizes and diverse types.

11 Claims, 1 Drawing Sheet

(56) References Cited

U.S. PATENT DOCUMENTS 3,131,300 A * 4/1964 Jeter ..... H01J 27/16 250/300
3,405,263 A * 10/1968 Wanless ..... H01J 49/147 250/285
3,518,424 A * 6/1970 Glock, Jr. ..... H01J 49/16 250/281
3,812,559 A * 5/1974 Spindt ..... B82Y 10/00 445/24
4,175,234 A * 11/1979 Hunt ..... H01J 49/16 250/281
4,677,295 A * 6/1987 Negra ..... H01J 49/40 250/287
5,222,663 A * 6/1993 Noakes ..... B05B 5/003 239/3
7,375,319 B1 * 5/2008 Willoughby ..... H01J 49/0463 250/288
9,721,775 B2 * 8/2017 Brown ..... H01J 49/0418
2005/0056776 A1 * 3/2005 Willoughby ..... H01J 49/06 250/288
2008/0006769 A1 * 1/2008 Staats ..... H01J 49/165 250/288
2010/0012830 A1 * 1/2010 Cristoni ..... H01J 49/04 250/282
2012/0119079 A1 * 5/2012 Ouyang ..... H01J 49/0431 250/282
2013/0248701 A1 9/2013 Kalinitchenko et al.
2015/0001389 A1 * 1/2015 Girault ..... H01J 49/0031 250/282

OTHER PUBLICATIONS

Ozdemir et al., "Triboelectric spray ionization", Journal of Mass Spectrometry. 2012.*
Qiao et al., "Electrostatic-Spray Ionization Mass Spectrometry", Journal of analytical chemistry 2012.*
Austin et al., "A compact time-of-flight mass spectrometer for high-flux ccosmic dust analysis", Journal of Geophysical research. 2003.*
International Search Report for PCT/CN2015/076322 dated Jun. 29, 2015, 2 Pages.
Written Opinion for PCT/CN2015/076322 dated Jun. 29, 2015, 5 Pages.
Klampfl, et al. "Direct ionization methods in mass spectrometry: An overiew", Analytica Chimica Acta 890 (2015) 44-59.
Liu, et al. "Leaf Spray: Direct Chemical Analysis of Plant Material and Living Plants by Mass Spectrometry", Anal. Chem. 2011, 83, 7608-7613.
Liu, et al. "Development and applications of paper-based electrospray ionization-mass spectrometry for monitoring of sequentially generated droplets", Analyst, 2013, 138, 2163-2170.

* cited by examiner

METHOD AND SYSTEM OF ATMOSPHERIC PRESSURE MEGAVOLT ELECTROSTATIC FIELD IONIZATION DESORPTION (APME-FID)

TECHNICAL FIELD

The present invention is related to methods and systems of ionization techniques based on the application of a megavolt electrostatic potential on samples of different sizes, shape and/or physical states, for ionization and desorption of at least one type of analyte in the sample.

BACKGROUND

Mass spectrometry (MS) is an indispensable analytical tool in modern chemical analysis, due to its detection sensitivity and specificity. Evolution of ionization methods results in a breakthrough for the application of MS analysis. The development of ionization techniques enables mass spectrometry to assist different field of analysis. Classical electron ionization and chemical ionization assist the analysis of volatile hydrocarbons and small organic pollutants. Nowadays, electrospray ionization and matrix-assisted laser desorption/ionization empower the development of biological MS for supporting various aspects of life science research (e.g. proteomics, metabolomics, and drug discovery). Recently, desorption/ionization techniques under atmospheric pressure for direct sample analysis by MS are becoming popular. The development of convenient and efficient atmospheric desorption/ionization techniques would expand the application of MS for the direct analysis of daily-life samples (e.g. food, pharmaceutical products) with simple and fast analytical procedure, and possibly bring MS from laboratory to the field.

The currently available atmospheric desorption/ionization techniques can be classified into electrospray-based, energetic particle-based, laser-based and coupled techniques. Desorption Electrospray Ionization (DESI) is an electrospray-based technique using a jet of solvent ions and molecules with nebulizing gas to hit the surface of sample for in-situ extraction of analyte molecules, and ionization and desorption of analyte ions. Low Temperature Plasma (LTP) Probe and Direct Analysis in Real Time (DART) techniques are energetic particle-based desorption/ionization techniques. LTP probe utilizes plasma of helium gas atoms/ions/radicals generated from dielectric barrier discharge. Molecules desorbed from sample surface by the thermal energy of the LTP would then be ionized via charge transfer reaction with the charged species in LTP. Similarly, DART generates excited/metastable helium atom via electrical discharge. Desorption of analyte molecules is resulted from a thermal process in addition to bombardment of excited atoms/ions. Femtosecond infrared laser is another type of an intense energy source employed for ambient desorption/ionization of analytes from solid sample for MS analysis. Analyte would be desorbed via thermal desorption, and ionization is believed to take place via the charge exchange reaction between charged species and neutral analyte molecules. Moreover, coupled techniques employ two desorption/ionization techniques to accomplish desorption and ionization separately. For instance, Laser Ablation Electrospray Ionization (LAESI) is a coupled technique employing laser desorption and subsequent electrospray ionization of neutral analyte. Recently, an atmospheric desorption/ionization techniques namely Field-induced Direct Ionization (using an electrical potential of 3-5 kV) has been reported for the direct detection of secondary metabolites of small living organisms (such as scorpion and toad). Nevertheless, all of these mentioned techniques require assisting reagents such as solvents and inert gases to operate, which can complicate matters. Types of samples that can be analyzed by currently available ambient ionization mass spectrometric methods are also limited to small-sized samples only.

The use of assisting reagents (e.g. helium) imposes additional reagent costs for operation, and also requires extra instrumentation (e.g. solvent supply system, vacuum pumping system) for the supply and removal of these reagents. Furthermore, the use of solvent causes the technique to become incompatible to solvent-sensitive samples. In addition, the change in identity/composition of these assisting reagents may lower the analytical performances of these atmospheric desorption/ionization techniques. For the Field-induced Direct Ionization technique, similar to other atmospheric ionization techniques, it is also confined to small organisms due to limitations in low ionization efficiency. In addition, it is limited to small and sharp samples as the relatively low electrical potential is used for the ionization of analyte molecules.

Hence, there is a need for atmospheric desorption/ionization method and system for MS, which is capable of directly generating ion from large-sized (and also small-sized) samples, without the use of assisting reagents (e.g. solvent, gas).

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

Provided herein are atmospheric desorption/ionization methods and systems for MS, which are capable of directly generating ions from large-sized (and also small-sized) samples, without the use of assisting reagents (e.g. solvent, gas).

The current invention is related to a completely new ionization method, namely Atmospheric Pressure Megavolt Electrostatic Field Ionization Desorption (APME-FID), for mass spectrometric analysis. It allows direct generation of ions from samples without the use of assisting reagents (e.g. solvent, gas, etc.). Hence the APME-FID technique could save the time and cost of sample analysis. More importantly, the use of megavolt electrostatic potential in APME-FID breaks the present limitation of the size of sample, while existing atmospheric desorption/ionization techniques (mostly operate at kilovolt electrical potential or below) are limited to small-sized sample analysis, APME-FID allows analytes on both large- and small-sized samples to be ionized for mass spectrometric analysis.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

BRIEF SUMMARY OF THE DRAWINGS

The drawings illustrate the features and other objects of the current invention, namely Atmospheric Pressure Megavolt Electrostatic Field Ionization Desorption (APME-FID) technique. Components of the drawings are not necessarily to scale, certain dimensions may be exaggerated in particular for clear description.

DETAILED DESCRIPTION

Figure 1:
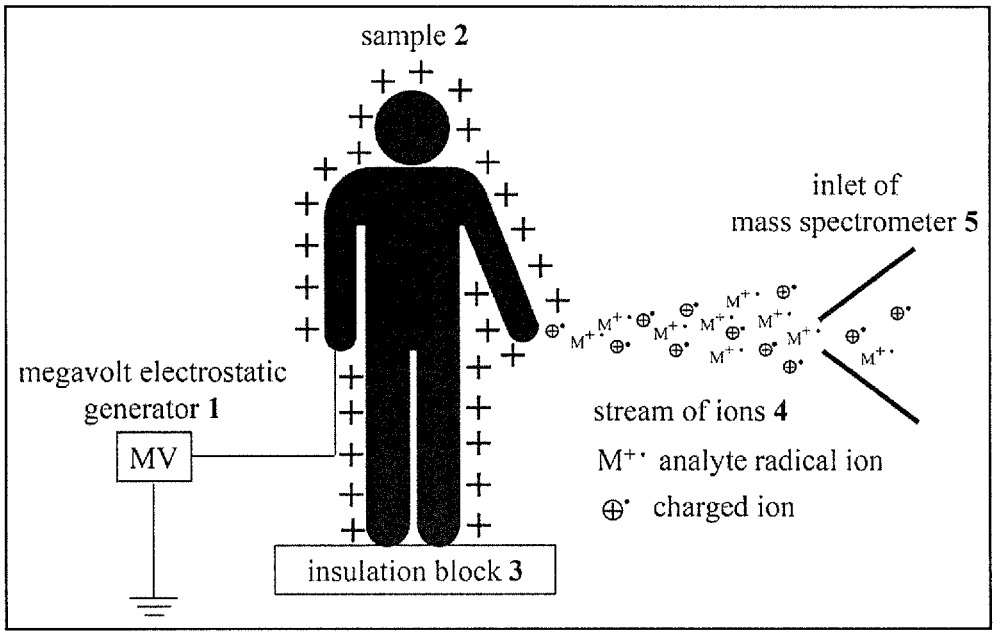
FIG. 1 is a schematic diagram of megavolt electrostatic charging of samples for ionization and desorption, and then detected by a mass spectrometer. The samples can include but not limited to human body, intact food or herbal samples, or pharmaceutical tablet.

The APME-FID technique employs a megavolt electrostatic potential to ionize analytes on samples. Sample is electrostatically-charged to a megavolt electrostatic potential. This technique enables the generation of ions directly from samples connected to a high electrostatic potential in the range from 10,000 V to megavolt conditions (greater than or equal to 100,000 V). The ions (e.g. molecular ions and/or fragment ions) generated by field ionization (or other mechanisms) on the sample surface are desorbed (e.g. by electrical repulsion) from the sample surface which possesses a high density of electrostatic charges, and then are directed to the inlet of a mass spectrometer for the detection, identification and quantitation.

This technique allows the direct analysis of samples of all sizes (e.g., ranged from an adult human to drug powder) and types (e.g. solid, liquid and gas) by using a mass spectrometer. The technique enables a diversified range of mass spectrometry applications such as real-time chemical/biochemical analysis of volatile substances exhaled from large living organisms, quality monitoring of herbal plant samples, and forensic/security checking of illicit drugs and explosives on human skin, without extensive sample preparation procedures. This invention breaks the current restriction and limitation of mass spectrometric analysis, and will open a new path to widen the application areas of MS technology to different aspects of field testing, including but not limited to security checking, forensic analysis, metabolic profiling, and other daily life sample analysis.

An aspect of the present invention employs a high electrostatic potential generated by a Van de Graaff generator or other similar electrostatic-charge generating devices, which enable gradual accumulation of high electrostatic potential on samples. The Van de Graaff electrostatic generator could generate either positive or negative charges at megavolt potential, for the field ionization of either or both positive and negative ions from the sample. In certain embodiments, the magnitude and polarity of the megavolt electrostatic potential can be varied before or during ionization. In certain embodiments, more than one megavolt electrostatic generator can be connected to the sample for ionization and desorption. In certain embodiments, the magnitude and polarity of the megavolt electrostatic potential can be controlled electronically.

In certain embodiments, accumulation of megavolt electrostatic potential on a sample can be accomplished by direct contact of the sample to electrostatic generator (e.g. for analysis of human body/breath). In another embodiments, the sample is indirectly connected to the electrostatic generator via a sample container (e.g. a probe, a tubing, a holder, a plate, etc) made of conductive (or dielectric) materials, for the ionization of any solid, liquid or gas samples. In certain embodiments, the sample is transferred within an insulating sample container (e.g. a probe, a tubing, a holder, a plate, etc), where only a part of the insulating sample container is connected to the electrostatic generator for ionization and desorption of analytes in the sample container. In certain embodiments, a sample container is put in the vicinity of the electrostatic generator without electrical connection. In certain embodiments, an automatic sample transport and changing system can be coupled with the electrostatic generator.

In certain embodiments, the sample is placed at the vicinity of the inlet of a mass spectrometer (or other ion detection/analysis devices) for ion collection. In certain embodiments, a transferring device (e.g. a capillary tube, etc) can be employed to transfer and/or guide ions and neutrals from the sample to the inlet of a mass spectrometer (or other ion detection/analysis devices).

In certain embodiments, the sample is placed in a housing with pressure control. In certain embodiments, the sample is placed in a housing with variable atmosphere composition (e.g. humidity level control, nitrogen level control, oxygen level control etc). In certain embodiments, the sample is placed in a housing, in which reagents can be introduced in gaseous, vapor or liquid form.

In certain embodiments, the sample to be analyzed can be in solid, liquid or gas states (or a mixture of these states). In certain embodiments, the sample could be in any physical shape (e.g. sharp, round, blunt, etc). In certain embodiments, the sample could have different physical sizes (e.g. adult human, luggage, pharmaceuticals, biological cells, etc). In certain embodiments, the sample could be commodities (e.g. crops, meat, vegetables, etc) and industrial products (e.g. pharmaceuticals, clothes, etc). In certain embodiments, the sample could be of biological origin (e.g. food, biological fluid, etc). In certain embodiments, the sample could be living biological samples (e.g. living human, living plants, living biological cells, etc). In certain embodiments, samples (e.g. blood, cytoplasm, fluids, etc) would be drawn from a living biological sample (e.g. living animal, plants, cell, etc) for real time chemical/biochemical monitoring. In certain embodiments, samples can be introduced from an instrument (e.g. a separating instrument).

In certain embodiments, the sample could be analyzed in its original state. In certain embodiments, the sample can be analyzed at ambient temperature, or under temperature control. In certain embodiments, additional reagents (e.g. solvent, inert gas etc) could be used to enhance detection sensitivity (e.g. facilitate ion generation and/or ion collection, etc). In certain embodiments, reference reagents (e.g. gas, liquid, powder, solution, etc) could be analyzed together or sequentially with the sample as an internal standard for analytical performance check and quantitative measurement applications.

In another aspect of the invention, ions desorbed or generated from the sample can be analyzed in multiple levels (e.g. chemically, spatially, etc). For example, ions can be characterized based on their mass, charge, cross-section area, mobility, velocity, momentum, etc), hence ion identity and location of desorption from a sample could be revealed.

In another aspect of the invention, photo energy can be directed or focused onto a selected area of sample to assist the ionization and/or desorption of at least one type of analytes (or ions).

In another aspect of the invention, the electrostatic potential could be applied at multiple stages, to assist or control the analyte being ionized. In certain embodiments, the electrostatic potential applied could assist the extraction of analytes from samples (e.g. disrupting biological membrane potential)

In another aspect of the invention, a replaceable sample probe (e.g. a disposable tip or sorbent, etc) which contains the analytes (e.g. in form of purified analytes, sample extract or raw sample, etc) can be connected to the electrostatic generator (directly or via electrical connection) for ionization of analyte and subsequent ion detection by a mass spectrometer (or other detection devices). The use of replaceable sample probe allows combination of sampling, sample storage and chemical analysis to be performed together without further sample extraction. This would simplify analysis procedure and enhance the efficiency of the analysis workflow. In certain embodiments, materials of the sample probe can be changed (e.g. polyester, polyethylene, cellulose, bonded silica sorbent, etc) for extracting different types of analytes from samples. In certain embodiments, reagents (e.g., solvent, acids, base) are added to enhance the detection of certain analytes or suppress the inference effect of sample matrix. In certain embodiments, the sample probe would be replaced by an automatic device during analysis.

The invention can be a method and system for ionization and desorption of molecules (analyte) at ambient pressure and temperature from a given sample at different physical states (e.g. solid, liquid, gas). The system includes an electrostatic generator 1 for generating and applying a megavolt electrostatic potential on the sample 2. The megavolt electrostatic generator 1 used in the experiments generate a potential in the range from +10,000 V to +1,000,000 V or wider in positive ion mode, and in the range from −10,000 V to −1,000,000 V or wider in negative ion mode. The system also includes electrical connecting device (e.g. sample holder) for directing the megavolt electrostatic potential on the sample 2. The sample 2 is electrostatically charged and analyte on sample 2 is ionized and desorbed by the megavolt electrostatic potential. The desorbed ions 4 are directed to any suitable detector, for example a mass spectrometer 5 for detection, identification and quantitation.

FIG. 1 illustrates schematically one embodiment of a system for practicing the invention. In this system, a sample 2 is electrically connected to a megavolt electrostatic generator 1. The sample 2 is under ambient condition. A megavolt electrostatic potential is generated by the megavolt electrostatic generator 1, which can be a Van de Graaff electrostatic generator. The sample 2 is then electrostatically charged. For large-sized samples 2 such as an adult human, an insulating block 3 is used to prevent it from being electrically grounded. The insulation box 3 can be made of insulating materials such as wood or plastic. The accumulation of high electrostatic charge is essential for ionization of analyte on the sample. Alternatively, if small- and medium-sized sample are being analyzed, they are connected to the megavolt electrostatic generator 1 via an electrically conductive sample holder without touching the ground, and hence the insulation block 3 is not required. Although a Van der Graaff electrostatic generator is described here, any device capable of generating a megavolt electrostatic potential may be used for electrostatic charging of the sample.

In positive ion mode, the megavolt electrostatic generator 1 generates a positive megavolt electrostatic potential. Hence a positive electrostatic potential is accumulated on the sample 2. Analytes on the surface of the sample 2 are ionized by electrostatic potential. Cations and radical cations 4 could be formed and desorbed from the sample surface due to electrical repulsion, as the surface of the sample 2 is positively-charged. The desorbed ions 4 could be transferred to the inlet of a mass spectrometer 5 for mass analysis and detection. The desorbed ions 4 are either collected by the inlet of mass spectrometer 5 directly, or transferred to the inlet of the mass spectrometer 5 with the assistance of an ion transferring device. Although the generation and detection of positive ions are described here, the invention can also be operated in negative ion mode for generation and detection of anions and radical anions. Briefly, a negative megavolt electrostatic potential is generated and applied to the sample, and negative ions are generated and detected using a mass spectrometer. The sample 2 can be a living organism at different sizes, for example an adult human, or some biological cells. The sample 2 can also be non-living materials, including but not limited to a slice of herbal plant tissue, fine chemical powders, a pharmaceutical tablet, flammable solvent absorbed in clothes, or explosives placed on the table (such as pharmaceutical tablet in solid phase, flammable solvent in liquid phase, and human breath in gas phase).

Figure 2:
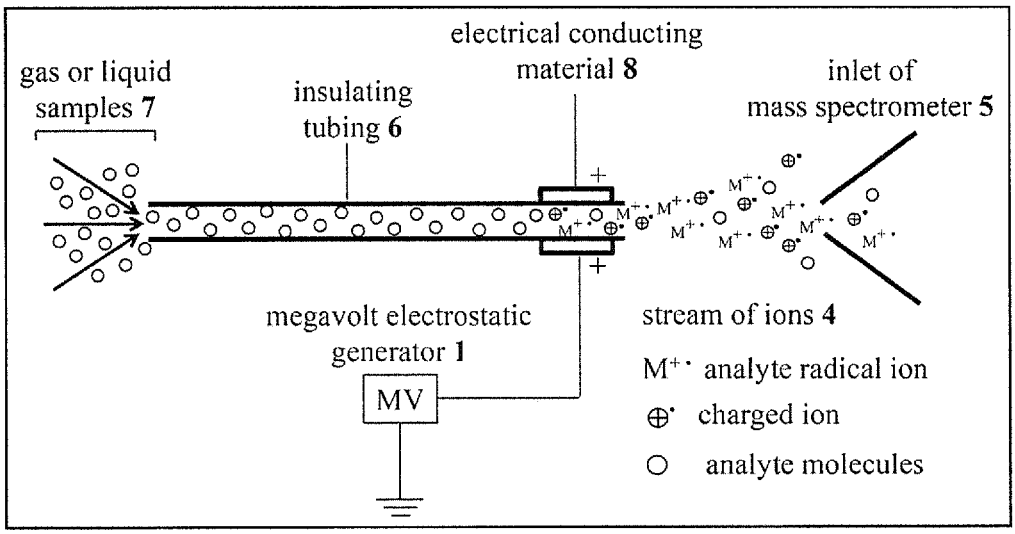
FIG. 2 is a schematic drawing depicting a configuration of the APME-FID interfacing device for the detection of liquid and gas samples. The liquid/gas samples can include but not limited to flammable solvents/human breath gas, respectively.

FIG. 2 illustrates schematically another embodiment of a system for practicing the current invention. In this system, an insulating sample transfer tubing 6 is connected to the electrostatic generator 1 via electrical conducting materials 8. The choice of electrical conducting materials 8 includes but not limited to metals or electrical conducting plastic. Gas or liquid sample 7 is injected from another end of the tubing 6. A megavolt electrostatic potential is generated by the megavolt electrostatic generator 1, which can be a Van de Graaff electrostatic generator. Analyte molecules in the samples 7 is ionized and desorbed by the megavolt electrostatic potential from the other end of the tubing 6. The tubing 6 is made of insulating material, including but not limited to wood, plastic and glass.

In positive ion mode, the megavolt electrostatic generator 1 generates a positive electrostatic potential which is applied to the sample transfer tubing 6. Cations and radical cations 4 could be formed and desorbed from the sample transfer tubing 6 due to electrical repulsion, as the tubing 6 is positively-charged. The stream of ions 4 is directed to the mass spectrometer 5 for mass analysis and detection, by pointing the exit of tubing 6 towards the inlet of the mass spectrometer 5. Although the generation and detection of positive ions are described here, the invention can also be operated in negative ion mode for the generation and detection of anions and radical anions. The samples 7 can be in either gaseous or liquid states. Gas samples may include but not limited to human breath gas, air pollutant samples, or samples output from gas chromatographic instrument or likewise; while liquid samples may include but not limited to water samples, drink samples, or samples eluted from liquid chromatographic instrument or likewise.

The examples illustrate the subject invention. Unless otherwise indicated in the following examples and elsewhere in the specification and claims, all parts and percentages are by weight, all temperatures are in degrees Centigrade, and pressure is at or near atmospheric pressure.

With respect to any figure or numerical range for a given characteristic, a figure or a parameter from one range may be combined with another figure or a parameter from a different range for the same characteristic to generate a numerical range.

Other than in the operating examples, or where otherwise indicated, all numbers, values and/or expressions referring to quantities of ingredients, reaction conditions, etc., used in the specification and claims are to be understood as modified in all instances by the term "about."

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A system for analyzing samples, comprising:

a megavolt electrostatic generator configured to generate megavolt electrostatic potential, an electrically conductive material operatively coupled to the megavolt electrostatic generator that directs the megavolt electrostatic potential to a sample comprising a plurality of analyte molecules, the sample being in a solid state, the plurality of analyte molecules ionized from the sample by the megavolt electrostatic potential to form a plurality of analyte ions, the plurality of analyte ions desorbed from the sample, an inlet positioned to facilitate a transfer of the plurality of analyte ions desorbed from the sample to an analyzer, the system configured to analyze the sample without the use of an assisting reagent, a laser desorption technique, or a combination thereof.

2. The system of claim 1, wherein the megavolt electrostatic generator is a Van de Graaff electrostatic generator.

3. The system of claim 1, wherein the analyzer is a mass spectrometer.

4. The system of claim 1, wherein the megavolt electrostatic generator is operatively coupled to the analyzer.

5. The system of claim 1, wherein the sample is directly connected to the megavolt electrostatic generator by the electrically conductive material.

6. The system of claim 1, wherein the sample is in touch with the electrically conductive material.

7. The system of claim 1, further comprising a sample stage, which is used for holding the sample.

8. The system of claim 1, further comprising a sample transfer tubing, which is used for holding and directing the sample close to the inlet.

9. The system of claim 1, wherein the analyzer is located in a close vicinity of the sample for collection of the plurality of analyte ions, and wherein the close vicinity is an adjustable distance.

10. The system of claim 1, further comprising an ion transferring device, which further facilitates the transfer of the plurality of analyte ions desorbed from the sample to the analyzer.

11. The system of claim 1, further comprising a sample container positioned adjacent to the electrically conductive material, wherein the sample container contains the sample under environmental conditions ambient to the system.

* * * * *